US009913350B2

(12) United States Patent
Wendt et al.

(10) Patent No.: US 9,913,350 B2
(45) Date of Patent: Mar. 6, 2018

(54) INTERFACE DEVICE AND METHOD FOR SUPPLYING POWER

(71) Applicant: PHILIPS LIGHTING HOLDING B.V., Eindhoven (NL)

(72) Inventors: Matthias Wendt, Eindhoven (NL); Marcel Beij, Eindhoven (NL); Martinus Petrus Creusen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/515,815

(22) PCT Filed: Sep. 25, 2015

(86) PCT No.: PCT/EP2015/072050

§ 371 (c)(1),
(2) Date: Mar. 30, 2017

(87) PCT Pub. No.: WO2016/050618

PCT Pub. Date: Apr. 7, 2016

(65) Prior Publication Data

US 2017/0311417 A1 Oct. 26, 2017

(30) Foreign Application Priority Data

Oct. 1, 2014 (EP) ..... 14187254

(51) Int. Cl.
*H05B 37/02* (2006.01)

(52) U.S. Cl.
CPC ..... *H05B 37/0245* (2013.01)

(58) Field of Classification Search
CPC ..... H05B 37/0854; H05B 37/0245
(Continued)

(56) References Cited

U.S. PATENT DOCUMENTS 5,884,086 A 3/1999 Amoni et al.
7,159,132 B2 1/2007 Takahashi et al.
(Continued)

FOREIGN PATENT DOCUMENTS

JP 2009064118 A 3/2009
JP 2012033129 A 2/2012
(Continued)

OTHER PUBLICATIONS

Nikkei Electronics vol. 1094, Oct. 29, 2012, pp. 35-40.

*Primary Examiner* — Douglas W Owens
*Assistant Examiner* — Syed M Kaiser

(57) ABSTRACT

The invention relates to an interface device for supplying power to a variable number of loads, which are configured to be coupled to the interface device by means of a supply line and which are configured to communicate with the interface device, to a system comprising such interface device and one or more loads, to a corresponding method for supplying power and to a corresponding software product. A particular feature of the present invention is that the interface device functions as an intermediate between an USB power source and the loads connected to the interface device by supplying power while being flexible to both sides, i.e. to the supplying side as well as to the load side, in allowing for a flexible number of loads to be coupled to the interface device (i.e. to be supplied by the interface device with power) and in also providing a negotiation with the power supply depending on the necessary power.

15 Claims, 2 Drawing Sheets

(58) Field of Classification Search
USPC ..... 315/151, 308, 307
See application file for complete search history.

(56) References Cited

U.S. PATENT DOCUMENTS

| | | | | |
|---|---|---|---|---|
| 2005/0128751 | A1* | 6/2005 | Roberge | F21K 9/00 362/276 |
| 2010/0007473 | A1 | 1/2010 | Fadell | |
| 2011/0208980 | A1 | 8/2011 | Brooks et al. | |
| 2012/0043907 | A1 | 2/2012 | Lu et al. | |
| 2012/0246458 | A1 | 9/2012 | Jain et al. | |
| 2012/0262093 | A1* | 10/2012 | Recker | H05B 33/0854 315/308 |
| 2013/0026830 | A1 | 1/2013 | Wright | |
| 2013/0038218 | A1* | 2/2013 | Xu | G05B 15/02 315/151 |
| 2014/0167623 | A1* | 6/2014 | Chobot | H05B 37/029 315/158 |

FOREIGN PATENT DOCUMENTS

| | | | |
|---|---|---|---|
| JP | 2013109461 | A | 6/2013 |
| WO | WO2012028981 | A1 | 3/2012 |

* cited by examiner

INTERFACE DEVICE AND METHOD FOR SUPPLYING POWER

CROSS-REFERENCE TO PRIOR APPLICATIONS

This application is the U.S. National Phase application under 35 U.S.C. § 371 of International Application No. PCT/EP2015/072050, filed on Sep. 25, 2015, which claims the benefit of European Patent Application No. 14187254.9, filed on Oct. 1, 2014. These applications are hereby incorporated by reference herein.

FIELD OF THE INVENTION

The invention relates to an interface device for supplying power to a variable number of loads, which are configured to be coupled to the interface device by means of a supply line and which are configured to communicate with the interface device, to a load to be coupled to such interface device, to a system comprising such interface device and one or more loads, to a method for supplying power to a variable number of loads by an interface device, which are configured to be coupled to the interface device by means of a supply line and which are configured to communicate with the interface device and to a corresponding software product.

BACKGROUND OF THE INVENTION

There is an ongoing trend of using track or cable systems for providing lighting ("track lighting" or "cable lighting"), in particular in areas like shops and museum, as well as in domestic areas. In these contexts, it may be desirable to flexibly change the number (or kind) of lighting elements, preferably even during operation of the lighting system, while furthermore the power supply is adjustable to the present need of the lighting system.

SUMMARY OF THE INVENTION

It is an object of the present invention to provide an interface device and a method for supplying power to a variable number of loads in a convenient and reliable way.

In a first aspect of the present invention an interface device for supplying power to a variable number of loads, which are configured to be coupled to the interface device by means of a supply line and which are configured to communicate with the interface device is presented, the interface device comprising a first connector for coupling the interface device with a USB device arranged to supply power according to one of the USB standards, a controller for controlling the operation of the interface device and arranged for receiving information from a load coupled to the supply line, a second connector for coupling the interface device with the supply line, wherein, upon startup of the interface device, the controller is arranged to control the first connector to receive power from the USB device at a first voltage and to control the second connector to forward power received by the first connector to the supply line at a second voltage, the second voltage set such the load coupled to the supply line is powered in a first mode, allowing the load to provide information to the controller, and to receive from loads coupled to the supply line information on the respective power requirements, wherein, during operation, the controller is further arranged to cause the first connector to negotiate, according to accumulated information on power requirements of loads coupled to the supply line, an increased power supply at a third voltage from the USB device and to cause the second connector to forward increased power received by the first connector to the supply line at a fourth voltage, such that the loads coupled to the supply line may be powered in a second mode.

In a further aspect of the present invention, a method for supplying power to a variable number of loads by an interface device is presented, which are configured to be coupled to the interface device by means of a supply line and which are configured to communicate with the interface device, the method comprising a first coupling step of coupling the interface device with a USB device arranged to supply power according to a USB standard, and a second coupling step of coupling the interface device with the supply line, and furthermore during a startup phase of the interface device a first startup control step of controlling to receive power from the USB device at a first voltage, a second startup control step of controlling to forward power received to the supply line at a second voltage, the second voltage set such the load coupled to the supply line is powered in a first mode, allowing the load to provide information to the interface device, and an information reception step of receiving from loads coupled to the supply line information on the respective power requirements, and additionally following the startup phase a negotiation step of negotiation, according to accumulated information on power requirements of loads coupled to the supply line, an increased power supply at a third voltage from the USB device, and a power step of forwarding increased power received from the USB device to the supply line at a fourth voltage, such that the loads coupled to the supply line may be powered in a second mode.

In yet a further aspect of the present invention, a software product for an interface device for supplying power to a variable number of loads is presented, the software product comprising program code means for causing the interface device to carry out the steps of the method according to the present invention when the software product is run on the interface device.

It is to be noted that a particular standard of interest to the present invention is USB Power Delivery (USB-PD), while even other standards are applicable. In cases other than USB-PB the amount of power supply itself (insofar it may extend beyond the details of the particular standard) may also be non-standard.

The present invention relates to a possibility of using USB for direct current (DC) supply for loads. In particular, the new standard USB-PD (USB Power Delivery, see, for example, USB Power Delivery Specification Revision 1.3 as part of Universal Serial Bus Revision 3.1 Specification) is of interest to the invention, while supporting up to 100 W power to be supplied from one side of a USB connection to the other side. A feature of USB standards in general and the USB-PD standard in particular is that power negotiation may be used for requesting and contracting power levels.

While this might be straightforward when load power is fixed or predetermined. The present invention, however, addresses cases like a situation of a track lighting system (or any other system including a variable number or amount of loads) in which the number of lamps can dynamically change even when power does not get removed.

A beneficial feature of particularly the USB-PD standard is that power negotiation is also available when power supply is active and electrical current is flowing. This is different to Power-over-Ethernet (PoE), for example, where the negotiation can only be done for a fresh connection before supply voltage gets switched on.

A second beneficial feature is that negotiation is mainly not using the USB data connection channel. However a new connection channel has been developed and discussed for USB-PD which is using the power conductors for the data connection in parallel by installing power line modems on both sides of the USB connection.

A particular feature of the present invention is that the interface device functions as an intermediate between the USB power source and the loads connected to the interface device. It is to be noted that the interface device (and accordingly the corresponding method) is different from conventional approaches of supplying power in being flexible to both sides, i.e. to the supplying side as well as to the load side, in allowing for a flexible number of loads to be coupled to the interface device (i.e. to be supplied by the interface device with power) and in also providing a negotiation with the power supply depending on the necessary power. Conventional approaches of power supply for a track lighting system, for example, are designed to be coupled to a power grid, i.e. a power source providing basically any desired power level (in the context of the system) without negotiation. On the other side, devices designed for negotiating the power level provided to them are nothing more than loads, i.e. such devices are not designed for providing a negotiable or variable power supply to other loads.

In a preferred embodiment, the controller is further arranged to monitor for the addition and/or removal of a load to/from the supply line and to cause the first connector to re-negotiate the power supply from the USB device based on a result of the monitoring.

The power supply by means of USB allows for a re-negotiation of the power to be supplied during operation such that it is not necessary to power down the system in case of a change in the number of loads connected, for example. An embodiment in the context of a track lighting system may have mechanisms for changes of the track lights. As the interface to the lamp controllers monitors for new lamps appearing and/or disappearing lamps from the collected list of loads, the changes in load requirements can be renegotiation as this is operable also when power is already applied (in contrast to Power-over-Ethernet (PoE) where negotiation only occurs once before power-up).

The monitoring for the addition of a load to the supply line and/or a removal of a load from the supply line may be based on techniques for actually monitoring a number of loads connected to the supply line by observing a status of the supply line.

In a preferred embodiment, however, the monitoring is provided by gathering information on a data link with the loads (which might be independent from the supply line as such). For example, a newly inserted track-lamp as an example of an added load would not automatically switch on (i.e. adding substantially to the consumed power) but would just boot its control processor which then asks via data connection for the power the lamp would need for proper powering. Similarly, a load might be arranged for signaling its removal from the supply line, e.g. by using residual power stored by its control processor for such purpose.

The monitoring via communication provides an effective means for guaranteeing that not accidentally all loads are left without power (e.g. all lights go off) because one load simply took too much power and an overcurrent protection switches off.

The power negotiation may be provided in such a way that the addition of a predetermined number of loads (e.g. at least one, or calculated based on the number of connected loads) or the need for a predetermined amount of power is taken into account. In other words, a certain amount of the power supplied from the USB device may be reserved for powering an added load in the first mode (e.g. providing a lamp driver with just enough power for communicating with the interface device).

In a preferred embodiment, the controller is arranged to compare the accumulated information on the power requirements of the loads with a predetermined threshold and/or a present threshold provided by the USB device and to take action in accordance with a predetermined set of rules.

In order to avoid an overload, mitigation techniques may be applied whenever more load (i.e. power) has been requested by the sum of loads than power has been granted during negotiation, the basis for which was the previously determined (i.e. current) sum of attached loads. As a result of, for example, an addition of a new load without a corresponding removal of another load, the currently granted power would be lower than the needed power. Indeed also from the very moment when a new load appears and thus an overload condition occurs because the negotiated power has not yet been renegotiated, an overload mitigation may be possible to keep the loads (or at least a subset thereof) operating (e.g. at least some lights might stay seamlessly on) before more power gets granted. A list of predetermined rules provided to the interface device can be used for selecting loads to be deactivated before overload conditions apply and power gets consequently completely removed. Alternatively also the load control may reduce maximum load for all or some of the loads e.g. by dimming lamps. An indicator lamp may be used to show this overload condition. Alternatively also an acoustic signal may be used to warn that more loads are on the track than can be fully powered. In other words, in a modification of the above preferred embodiment, in case the comparison indicates an overload, the controller is arranged to select one or more loads to be deactivated, select one or more loads and control the selected load(s) for reducing a respective power intake, provide a signal to a user indicating an overload situation, and/or provide an interface for a user for controlling one or more loads manually. The interface device may or may not be arranged, in case of finding of an overload, to first try re-negotiation of the power supply with the USB device, while only as far as such re-negotiation would not be successful (i.e. just some but not all additional power is granted), one or more of above mitigation attempts would be made. The signal, which may be provided by the controller in case of an overload situation (present or anticipated), can be provided by the interface device itself (using any kind of suitable indicator, in particular by optical and/or acoustic indication) and/or can be caused indirectly by the controller, for example by instructing one or more of the loads to do the indication (e.g. a load being or including a lighting element may provide pulsating lighting output and/or change lighting color and/or intensity). It is indeed possible to provide a combination of several of such options. The controller may also be arranged to have a flexible approach in this respect like using a load for signaling in case such compatible load is present and indicating the signal by the interface device itself otherwise.

In a preferred embodiment, the interface device is arranged to communicate with a load by means of at least one of a control line parallel to the supply line, power line communication using the supply line and wireless communication using WiFi, ZigBee, Bluetooth and/or IR.

One possibility for allowing communication is a control rail of a track system or the like which allows data exchange between loads and the interface device. Other possibilities for the data connectivity between loads (e.g. lamps) and the interface device include using wireless techniques (like WiFi, ZigBee, Bluetooth, IR) or power line communication. As these techniques in general are well known, no further explanation thereof is necessary. It is noted that the communication between the load(s) and the interface device may also follow a protocol of one of the USB standards for data or information exchange while using the supply line, the control line, a combination of supply and control line or even a further line for communication.

In a preferred embodiment, the first connector includes a negotiation unit for negotiation with the USB device, wherein the negotiation unit is included in a USB plug or receptacle of the first connector.

The provision of at least the negotiation unit in the USB plug is helpful in reducing an impact of limitations as to cable length in the context of USB connections. Further elements of the interface device may be provided also close to the USB plug and/or at a distance therefrom. The same also applies to the case where not the plug but the receptacle (for receiving an USB plug provided on the USB device supplying the power) is provided with the interface device.

In a preferred embodiment, the first voltage and the second voltage are both 5 V, wherein furthermore (or independent therefrom) the third voltage and the fourth voltage are the same and one of 12 V and 20 V.

It is to be understood that the indication of these voltages in the context of an USB standard also covers the allowed range according to such standard (e.g. 4.45 to 5.25 V in the case of USB 3.0). Similar tolerances applied to the preferred voltages of 12 V and 20 V yield ranges of 10.68 V to 12.6 V and 17.8 V to 21 V, respectively.

In a preferred embodiment, the controller is arranged to, upon receipt of the increased power at the third voltage, communicate to the coupled loads to enter into the second mode.

The communication causing the loads to enter into the second mode may be by means of such communication lines or ways as indicated above, while the communication may also be just implicit by providing the fourth voltage.

According to the present invention, a load is presented, which is arranged for being coupled to the interface device according to the invention and for receiving power from the interface device by means of a supply line, the load comprising a driver and a consumer and/or a receptacle for a consumer, wherein the driver is arranged to control the consumer and/or an internal supply of power to the consumer, wherein the driver is arranged to operate in at least a first mode and a second mode, wherein the first mode is provided for a case of power being received by the load at a second voltage and the second mode is provided for a case of power being received by the load at a fourth voltage, wherein the driver is arranged to, at least in the first mode, provide information to the interface device on a power requirement for the second mode, and further arranged to switch to the second mode, in which the consumer is powered up in comparison to the first mode.

In a preferred embodiment, the load includes at least or is a lighting device. A lighting device, for example, may specifically be designed to operate as a load according to the present invention. Alternatively, or in addition, the load may also be arranged such that a (for example, conventional) lighting device as an example for a consumer may be coupled to the load (i.e. received in the receptacle), thus allowing for retro-fitting conventional lighting device to the present invention.

In a preferred embodiment, the driver is arranged to monitor a voltage applied to the supply line by the interface device and are further arranged to enter the second mode upon detecting the fourth voltage being applied to the supply line.

In case such monitoring of the applied voltage is provided, there is no need for additional communication for signaling to the one or more loads that the second mode is to be provided, as the application of the fourth voltage imply such mode change.

In addition or in an alternative, a load may also be arranged such that one or more certain circuits (or parts thereof) remain inactive by design in the presence of the second voltage, while becoming active only upon supply of the fourth voltage.

It is furthermore foreseen that the load may indicate its own state or a state (e.g. mode) or of the overall system (see also below, e.g. overload) to a user via a lighting output (or some other means of indication) of the load.

According to the present invention, also a system is presented, including the interface device according the present invention, one or more loads configured to communicate with the interface device and configured to be powered in a first mode upon supply of a second voltage and in second mode upon supply of a fourth voltage, and a supply line for coupling the interface device and the one or more loads.

Here the one or more loads preferably include at least a lighting device.

In a further preferred embodiment, the supply line includes a track and/or cables for mounting the one or more loads, i.e. the system is a track or cable system like systems used for track or cable lighting.

In a further aspect of the present invention a computer program is presented for an interface device for supplying power to a variable number of loads, the software product comprising program code means for causing the interface device to carry out the steps of the method according to the invention when the software product is run on the interface device.

A yet further aspect of the present invention provides a computer program for an load designed for receiving power from an interface device according to the invention, the software product comprising program code means for causing the load to carry out the steps of a control method including an operation in a first mode including a provision of the information of power requirements of the load to the interface device and an operation in a second mode including powering up of a consumer of the load.

It shall be understood that the interface device of claim 1, the load of claim 10, the system of claim 13, the method of claim 14, and the computer program/software product of claim 15 have similar and/or identical preferred embodiments, in particular, as defined in the dependent claims.

It shall be understood that a preferred embodiment of the invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
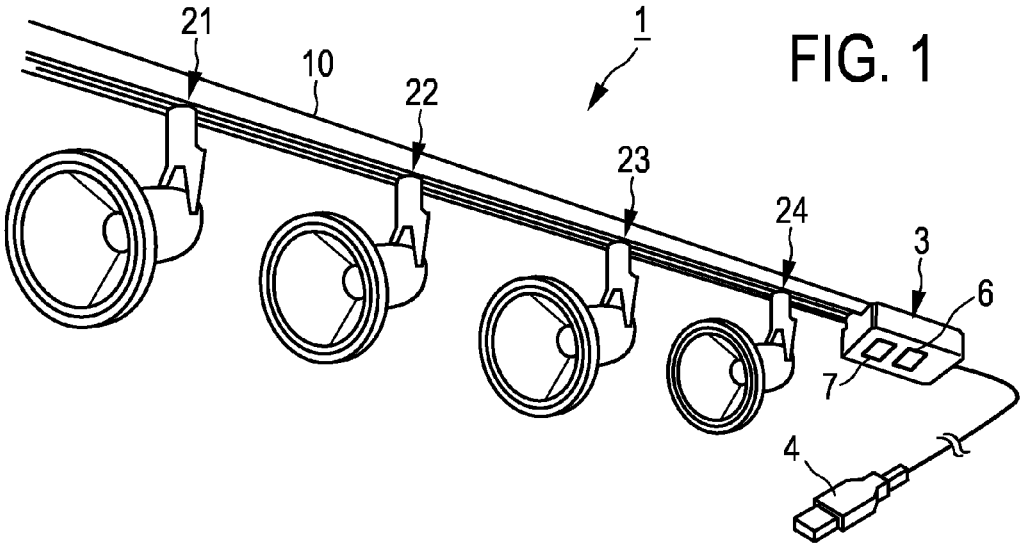
FIG. 1 shows an overview of a system including an interface device in accordance with an embodiment of the invention.

FIG. 1 shows an overview of a system including an interface device in accordance with an embodiment of the invention. The system 1 as illustrated in FIG. 1 includes a track arrangement 10, to which lamps 21, 22, 23, 24 as loads are coupled and which is also connected with an interface device having an interface device body 3 and a USB connector 4, wherein furthermore the interface device body 3 is provided with an indicator 6 and a user interface 7.

The interface device 3, 4 is to be coupled with a USB device (not shown) arranged to supply power according to a USB standard, wherein, in turn, the interface device is coupled to the track arrangement 10 for providing power to the lamps 21, 22, 23, 24.

Figure 2:
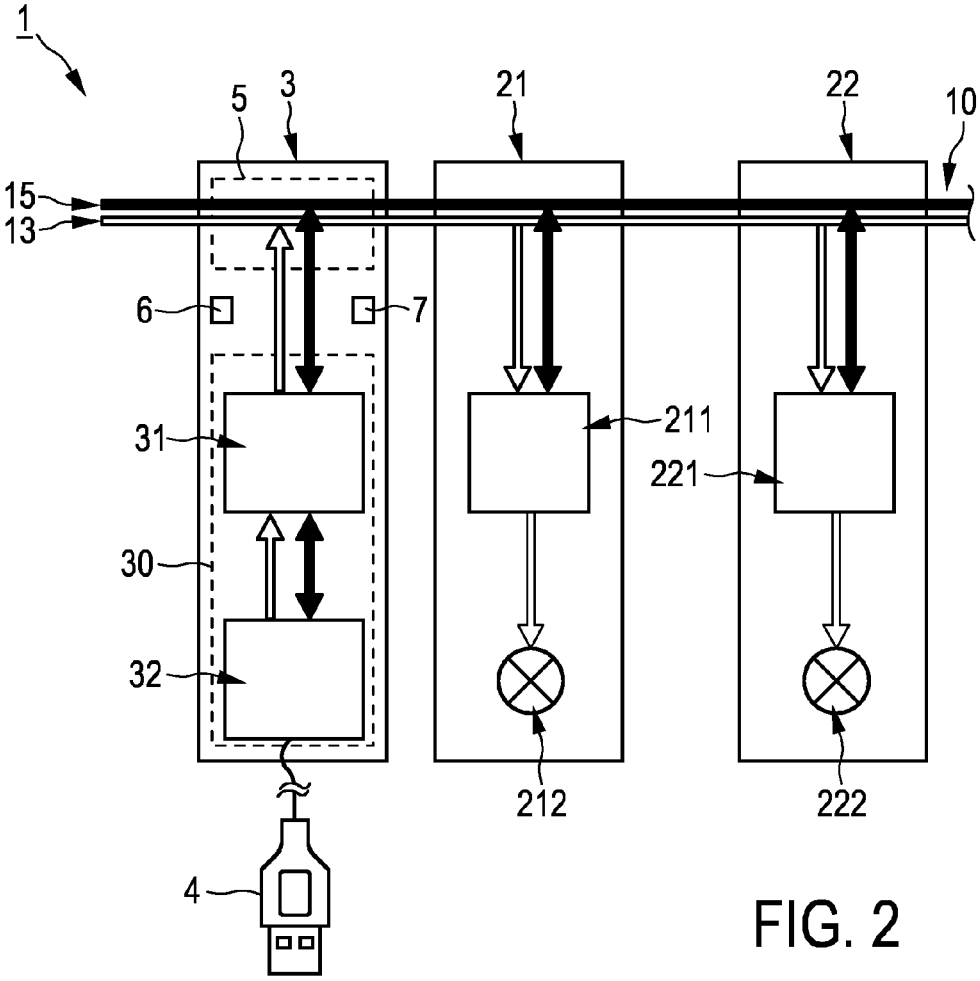
FIG. 2 shows a different schematic illustration of the system including the interface device in accordance with the embodiment of the invention shown in FIG. 1.

FIG. 2 shows a different schematic illustration of the system including the interface device as shown in FIG. 1, while only two loads, namely lamps 21, 22 are shown.

The lamps 21, 22 are provided with lamp drivers 211, 221 and lighting elements 212, 222, respectively, where the lamp drivers 211, 221 control the lighting elements 212, 222.

The lamps 21, 22 are connected to the track arrangement 10, which includes a supply rail 13 (supply line) and a control rail 15 (control line) to which also the interface device 3, 4 is connected. The interface device 3, 4 includes the interface device body 3 and the USB connector 4.

The interface device 3, 4 includes a controller 30, which is provided with control logic 31, 32 for a first connector and a second connector. The first connector includes the control logic 32 and the USB plug 4 and is provided for coupling the interface device 3, 4 with a USB device (not shown) for receiving power from the USB device according to a USB standard. The second connector including the control logic 31 and a track coupling 5 is provided for coupling the interface device with the supply rail 13 of the track arrangement 10.

Upon start up of the interface device, the controller 30 controls the first connector 32, 4 to received power from the USB device at a first voltage (5V) wherein this voltage and power is forwarded to the lamps 21, 22 via the track arrangement 10, such that the lamp drivers 211, 221 may be powered in a first mode, in which these lamp drivers 211, 221 are arranged to communicate their respective power requirement to the controller 30. The controller 30 accumulates the received information from the connected lamps 21, 22 and determines the power needed for supplying the respective power to the lamps 21, 22. Accordingly, the controller 30 causes the first connector 32, 4 to negotiate with the USB device supplying power in order to receive the proper amount of power from the USB device. Once the power is provided from the USB device, the power is forwarded by the second connector 31, 5 to the track 10, such that the lamps 21, 22 may power up to a second mode in which the lamps provide lighting, while in the first mode the lamps 21, 22 are not yet in operation.

The controller 30 is provided with logic for comparing the accumulated information on the power requirements with a predetermined threshold or a threshold provided by the USB device. In case of an overload, the controller is arranged for indicating such overload by means of an indicator 6 provided in the interface device body 3. Depending on the circumstances, the controller 30 follows a predetermined set of rules for addressing the overload situation. In the present embodiment, the controller 30 is arranged to provide an interface 7 for a user for controlling one or more loads manually.

After the power up is provided, the controller 30 is arranged to monitor for a removal or in addition of a lamp to the track and to provide, if necessary, for a re-negotiation about the power provided by the USB device.

As indicated above, the lamp drivers 211, 221 control operation of the lighting elements 212, 222, which are example for consumers of a load, respectively. Such control may be limited to just controlling or regulating a supply of power to the lighting elements internal to the lamps 21, 22, wherein it is also possible that the lamp drivers 211, 221 control further details of the operation of the lighting elements.

In the first mode, i.e. upon receiving power at the second voltage, the lamps drivers 211, 221, respectively, provide information to the interface device 3, 4 on a power requirement for the second mode.

Figure 3:
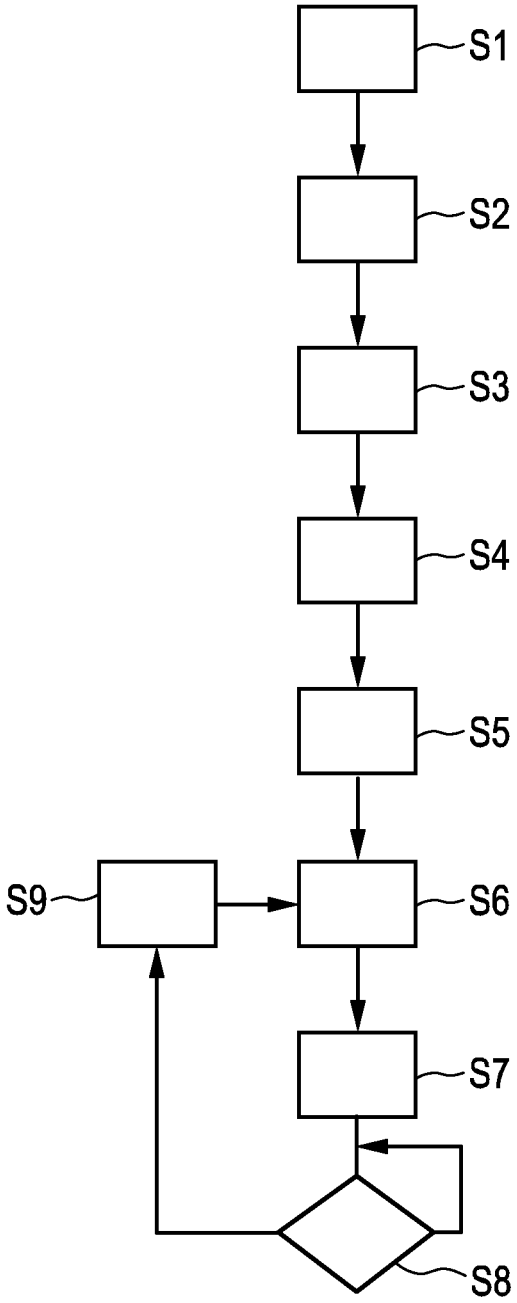
FIG. 3 shows a schematic flow diagram of a method for supplying power in accordance with an embodiment of the invention.

In response to a suitable signaling (e.g. a signal via the communication means for communication with the interface device 3,4 or just implicitly provided by provision of the fourth voltage), the lamp drivers 211, 221 switch to the second mode, in which than the respective lighting element 212, 222 is powered for full operation. FIG. 3 shows a schematic flow diagram of a method for supplying power in accordance with an embodiment of the invention.

The method starts with a first coupling step S1 of coupling an interface device with a USB device arranged to supply power according to a USB standard. Such coupling step might be provided in form of physically coupling the interface device with the USB device or as a logical coupling, for example, in the form of activating a previously physically arranged connection between the interface device and the USB device. The first coupling step S1 is followed by a second coupling step S2 of coupling the interface device with a supply line, to which one or more loads are connected. Again, the coupling addressed in this second coupling step S2 might be a physical coupling and/or a logical coupling in terms of, for example, activating a previously provided physical coupling.

The order of the first coupling step S1 and the second coupling step S2 is of no relevance in this term and might be reversed, wherein furthermore the first coupling step S1 and the second coupling step S2 might also be provided simultaneously. Following the coupling steps S1, S2, during a start up phase of the interface device there is a first start up control step S3, in which the interface device is controlled to receive power from the USB device at a first voltage.

Once the first voltage, typically 5V, is provided from the USB device, in a second start up control step S4 the power received from the USB device is forwarded to the supply line at a second voltage, which is typically identical with the first voltage, wherein this second voltage is of such nature that the loads coupled to the supply line are powered in a first mode, such that the coupled load(s), may provide information to the interface device.

In the interface device, there is provided an information reception step S5 of receiving, from loads coupled to the supply line, information on the respective power requirements.

Once such information is accumulated, a negotiation step S6 is provided following the start up face, during which an increased power supply at a third voltage (e.g. 12V or 20V) is negotiated from the USB device.

Once such increased power is provided, in a power step S7 at least a portion of the provided power is forwarded from the USB device to the supply line and to the loads at a fourth voltage, which is typically identical to the third voltage provided from the USB device for supplying the increased power, such that the loads coupled to the supply line may be powered in a second mode, the normal operation mode of such loads, e.g. a lighting mode of lighting elements as loads, for example.

In the present embodiment, after the power step S7 a monitoring step S8 is provided for checking whether or not there is a change in the required power, for example, due to a removal or an addition of a load. If there is no change in required power, the monitoring step S8 is repeated.

In case there is a change in the power, a new accumulating step S9 is provided and the flow returns to the negotiation step S6 as indicated in FIG. 3.

For sake of simplification, additional steps like handling an overload situation and/or details of the communication between the interface device and the loads and the interface device and the USB device are omitted, even though such steps may, of course, be provided in an appropriate manner.

In one possible implementation, the invention is realized in a track lighting system including a track with conductors embedded in a U-shape that carries a number of fixtures and a USB connection module (as an example of the interface device) with a cable that ends in a USB plug. The USB connection module is acquiring the total amount of power required for all loads on a track and requesting that as a package from USB-PD. This track concept uses a track interfacing function in combination with a USB interfacing function in order to control and power the track lamps. A supply rail is provided which powers every track load and also a control rail provided which allows data exchange between loads and the USB interface.

It is to be noted that the present invention may be used in the context of conventional track lighting arrangements (like the one discussed above with a supply rail and a control rail), wherein it is possible to use either in addition or as an alternative to the control rail as a communication line also other communication means (e.g. power line via the supply rail or WiFi, ZigBee, Bluetooth and/or IR) for communication between the interface device and any one of the loads. A mix of communication methods is also possible, e.g. in case there are differently designed loads presented, which use different communication means.

A possible implementation of a method or process according to the invention includes during system power-up negotiation the steps:

during boot USB-PD 5V is applied by a PD supply over the USB connector and used to boot the interface processor in the USB interface and the lamp control processors in lamp drivers, an interface processor in the USB interface starts collecting information about power requirements from the control processors in lamp drivers, a negotiation starts with the collected load power figures and power gets contracted, the USB-PD voltage steps up to 12V or 20V. This signals the lamps to start.

From thereon, lamp control can be provided from system level by means of the USB data connection the USB-PD negotiation phy or any other wired or wireless means (e.g. using a ZigBee control system).

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single processor, device or other unit may fulfill the functions of several items recited in the claims. The mere fact that certain measures are recited in mutually different dependent claims does not indicate that a combination of these measures cannot be used to advantage.

Operations like monitoring, controlling, comparing and calculating can be implemented as program code means of a computer program and/or as dedicated hardware.

A computer program may be stored and/or distributed on a suitable medium, such as an optical storage medium or a solid-state medium, supplied together with or as part of other hardware, but may also be distributed in other forms, such as via the Internet or other wired or wireless telecommunication systems.

Any reference signs in the claims should not be construed as limiting the scope.

The invention claimed is:

1. An interface device for supplying power to a variable number of loads, which are configured to be coupled to the interface device by means of a supply line and which are configured to communicate with the interface device, the interface device comprising:

a first connector for coupling the interface device with a USB device arranged to supply power according to a USB standard, a controller for controlling the operation of the interface device (3, 4) and arranged for receiving information from a load coupled to the supply line (13), a second connector for coupling the interface device with the supply line, wherein, upon startup of the interface device, the controller is arranged to control the first connector to receive power from the USB device at a first voltage and to control the second connector to forward power received by the first connector to the supply line at a second voltage, the second voltage set such the load coupled to the supply line is powered in a first mode, allowing the load to provide information to the controller, and to receive from loads coupled to the supply line information on the respective power requirements, wherein, during operation, the controller is further arranged to cause the first connector to negotiate, according to accumulated information on power requirements of loads coupled to the supply line, an increased power supply at a third voltage from the USB device and to cause the second connector to forward increased power received by the first connector to the supply line at a fourth voltage, such that the loads coupled to the supply line powered in a second mode.

2. The interface device according to claim 1, wherein the controller is further arranged to monitor for the addition and/or removal of a load to/from the supply line and to cause the first connector to re-negotiate the power supply from the USB device based on a result of the monitoring.

3. The interface device according to claim 1, wherein the controller is arranged to compare the accumulated information on the power requirements of the loads with a predetermined threshold and/or a present threshold provided by the USB device and to take action in accordance with a predetermined set of rules.

4. The interface device according to claim 3, wherein, in case the comparison indicates an overload, the controller is arranged to select one or more loads to be deactivated, select one or more loads and control the selected load(s) for reducing a respective power intake, provide a signal to a user indicating an overload situation, and/or provide an interface for a user for controlling one or more loads manually.

5. The interface device according to claim 1, wherein the interface device is arranged to communicate with a load by means of at least one of a control line parallel to the supply line, power line communication using the supply line and wireless communication using WiFi, ZigBee, Bluetooth and/or IR.

6. The interface device according to claim 1, wherein the first connector includes a negotiation unit for negotiation with the USB device, wherein the negotiation unit is included in a USB plug or USB receptacle of the first connector.

7. The interface device according to claim 1, wherein the first voltage and the second voltage are both 5 V.

8. The interface device according to claim 1, wherein the third voltage and the fourth voltage are the same and one of 12 V and 20 V.

9. The interface device according to claim 1, wherein the controller is arranged to, upon receipt of the increased power at the third voltage, communicate to the coupled loads to enter into the second mode.

10. A load arranged for being coupled to an interface device according to claim 1 and for receiving power from the interface device by means of a supply line, the load comprising:

a driver and a consumer and/or a receptacle for a consumer, wherein the driver is arranged to control the consumer and/or an internal supply of power to the consumer, wherein the driver is arranged to operate in at least a first mode and a second mode, wherein the first mode is provided for a case of power being received by the load at a second voltage and the second mode is provided for a case of power being received by the load at a fourth voltage, wherein the driver is arranged to, at least in the first mode, provide information to the interface device on a power requirement for the second mode, and further arranged to switch to the second mode, in which the consumer is powered up in comparison to the first mode.

11. The load according to claim 10, wherein the load includes at least a lighting device.

12. The load according to claim 10, wherein the driver is arranged to monitor a voltage applied to the supply line by the interface device and is further arranged to enter the second mode upon detecting the fourth voltage being applied to the supply line.

13. A system, including:

the interface device according to claim 1, one or more loads according to claim 10, and a supply line for coupling the interface device and the one or more loads.

14. A method for supplying power to a variable number of loads by an interface device, which are configured to be coupled to the interface device by means of a supply line and which are configured to communicate with the interface device, the method comprising:

a first coupling step of coupling the interface device with a USB device arranged to supply power according to a USB standard, and a second coupling step of coupling the interface device with the supply line, during a startup phase of the interface device:

a first startup control step of controlling to receive power from the USB device at a first voltage, a second startup control step of controlling to forward power received to the supply line at a second voltage, the second voltage set such the load coupled to the supply line is powered in a first mode, allowing the load to provide information to the interface device, and an information reception step of receiving from loads coupled to the supply line information on the respective power requirements, and following the startup phase:

a negotiation step of negotiation, according to accumulated information on power requirements of loads coupled to the supply line, an increased power supply at a third voltage from the USB device, and a power step of forwarding increased power received from the USB device to the supply line at a fourth voltage, such that the loads coupled to the supply line powered in a second mode.

15. A software product stored on a nontangible media for an interface device for supplying power to a variable number of loads, the software product comprising program code causing the interface device to carry out the steps of the method as claimed in claim 14 when the software product is run on the interface device.

* * * * *